United States Patent [19]

Devir

[11] Patent Number: 4,724,353

[45] **Date of Patent: * Feb. 9, 1988**

[54] ELECTRIC LAMP WITH INSULATING BASE

[75] Inventor: Daniel D. Devir, S. Sutton, N.H.

[73] Assignee: GTE Products Corporation, Danvers, Mass.

[ * ] Notice: The portion of the term of this patent subsequent to Jul. 29, 2003 has been disclaimed.

[21] Appl. No.: 880,648

[22] Filed: Jun. 27, 1986

Related U.S. Application Data

[63] Continuation of Ser. No. 580,917, Feb. 16, 1984, abandoned.

[51] Int. Cl.[4] ..... H01J 5/48; H01J 5/50

[52] U.S. Cl. ..... 313/318; 313/315; 439/611; 439/615; 439/619; 439/731

[58] Field of Search ..... 313/318, 315, 324, 49, 313/323; 339/144 R, 145 R, 176 L, 208, 210

[56] References Cited

U.S. PATENT DOCUMENTS

| | | | |
|---|---|---|---|
| 2,053,138 | 9/1936 | Donovan | 339/144 R |
| 2,268,700 | 1/1942 | Criger et al. | 313/318 |
| 3,739,221 | 6/1973 | De Bleyker et al. | 313/318 |
| 3,781,755 | 12/1973 | Pitacco | 339/14 R |
| 3,781,768 | 12/1973 | Howe | 339/125 L |
| 3,805,215 | 4/1974 | Davis, Jr. | 339/176 L |
| 3,829,729 | 8/1974 | Westlund, Jr. et al. | 313/318 |
| 3,881,798 | 5/1975 | Horan | 339/144 R |
| 3,898,506 | 8/1975 | Willoughby et al. | 313/318 |
| 3,910,668 | 10/1975 | Wasmeir | 339/65 |
| 3,911,266 | 10/1975 | Oram | 339/176 L |
| 3,979,627 | 9/1976 | Leadvaro et al. | 313/318 |
| 4,028,577 | 6/1977 | Gates et al. | 313/318 |
| 4,373,771 | 2/1983 | Cross et al. | 339/176 L |
| 4,603,278 | 7/1986 | Devir et al. | 313/315 |

FOREIGN PATENT DOCUMENTS

| | | | |
|---|---|---|---|
| 071060 | 10/1959 | France | 313/318 |
| 0305581 | 12/1929 | United Kingdom | 313/318 |
| 1103227 | 2/1968 | United Kingdom | 313/318 |

*Primary Examiner*—David K. Moore
*Assistant Examiner*—Michael Razavi
*Attorney, Agent, or Firm*—Lawrence R. Fraley

[57] ABSTRACT

An electric, incandescent lamp including an electrically insulating (e.g., plastic) base which is securedly positioned on the lamp's sealed end portion without the need for adhesives or the like. The base functions to securedly retain the lamp's lead-in wires (a total of four in a dual filament lamp) in a preestablished alignment externally of the lamp's sealed end (from which the wires project) to thereby assure positive electrical connection thereto when the lamp and base are inserted within a corresponding electrical socket. The invention is ideally suited for use in a tail light assembly for an automobile.

5 Claims, 2 Drawing Figures

ELECTRIC LAMP WITH INSULATING BASE

This application is a continuation, of application Ser. No. 5,80,917, filed 2/16/84 now abandoned.

1. Technical Field

The invention relates to electric incandescent lamps and, more particularly, to such lamps which include an electrically insulating base as part thereof.

2. Background

The features of the present invention are particularly useful as applied to the construction of incandescent lamps employed in automobiles, such as the dual-filament lamps employed in tail light assemblies.

One well known example of existing lamps of this type generally employed a type S-8 glass bulb cemented in a brass, double contact bayonet base. Although used for a number of years, such bases pose a number of disadvantages. For example, anyone who has replaced such a lamp in their automobile will appreciate the great difficulty experienced in position-referencing the base to insure the proper lamp-to-socket orientation. The base is cylindrical and the only orientation reference means are small indexing pins at the sides of the base. This referencing problem also holds true for automatic insertion of the lamp into the socket during production thereof. Further, the lamp to base construction for dual filament lamps of this type requires three soldering points for electrical connections (the two lead-in wires serving as the common connection are twisted and soldered to the sidewall of the base, while the other two wires are respectively soldered to the twin contact nodes at the bottom of the base). This leads to corrosion or other contact degradation problems caused by soldering fluxes. Finally, the bayonet base lamp requires a somewhat complicated and relatively expensive socket design.

One attempted solution to the several aforementioned problems inherent in brass base lamps is defined in U.S. Pat. No. 4,028,577 (P. E. Gates et al), said patent assigned to the same assignee as the instant invention and being a continuation-in-part of U.S. Pat. No. 3,979,627 (S. J. Leadvaro et al). In U.S. Pat. No. 4,028,577, there is described an electric lamp having a sealed end containing therein (or extending therefrom) a reentrant glass stem sealed about its periphery to the glass bulb. This end is positioned within a plastic base having a cylindrical body portion (for housing the somewhat cylindrical-shaped sealed end) and adjacent wedge portion. While this concept proved advantageous in several ways over the aforementioned brass base lamps, it was necessary to provide additional features, steps, etc. in order to satisfactorily produce and utilize this arrangement. For example, it was necessary to position the extending tip segment (from the sealed end) a sufficient distance from the base's inner, bottom wall in order to provide protection thereof. Maintenance of this distance was assured by cementing the bulb (along the outer walls) to the base. It was also necessary in this design to pass the lamp's projecting lead-in wires through corresponding passages (holes) within the base, thus mandating a relatively complex (and time-consuming) alignment and insertion procedure. Even further, final lead-in wire retention necessitated yet another production step (e.g., heat staking) which added still further to the cost of this lamp.

DISCLOSURE OF THE INVENTION

It is therefore a primary object of this invention to enhance the electric lamp art.

It is a particular object of this invention to provide an electric lamp which is relatively simple in design, can be readily and inexpensively produced and which eliminates the need for soldering or the like and the typical problems associated therewith.

It is yet another object of this invention to provide such a lamp wherein the lamp's projecting lead-in wires are both positively aligned and retained externally of the lamp's sealed end to thereby assure positive electrical connection thereto when the lamp is positioned (e.g., inserted) within a corresponding socket component.

These and other objects, advantages and features are attained, in accordance with the principles of this invention, by an electric lamp comprising a sealed, light-transmitting envelope having a bulbous portion and a press sealed end portion adjacent thereto, at least one filament located within the bulbous portion of the envelope, a pair of lead-in conductors connected to each filament and sealed within the press seal end portion of the envelope and projecting exteriorly thereof, and an electrically insulating base member which is secured to a first part of the press sealed end portion and provides a cover therefor, said base member including therein means for aligning the exteriorly projecting portions of the conductors in predetermined alignment against a respective external surface of the press sealed end portion. The remaining, second part of the press sealed end portion is not covered by the base and is adapted for being positioned within a socket member or the like wherein electrical contacts are located, said contacts electrically contacting the portions of the lead-in conductors which lie adjacent the exposed second part of the press sealed end portion.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
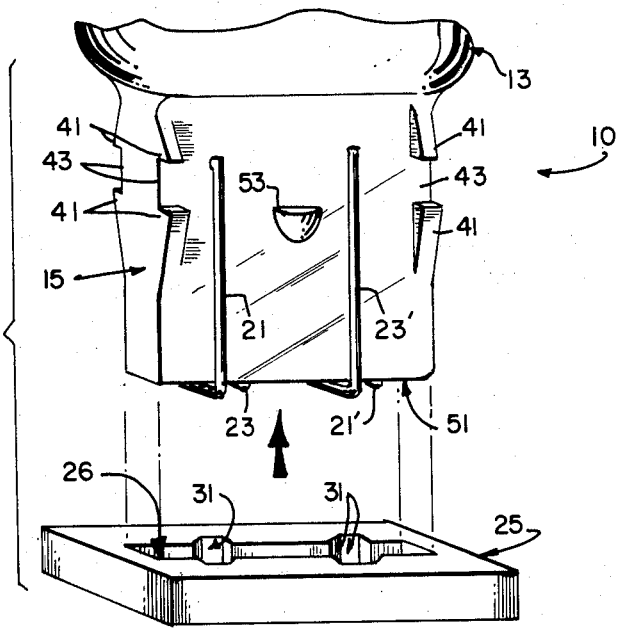
FIG. 1 is an exploded partial perspective view of an electric lamp in accordance with the teachings of the instant invention.
Figure 2:
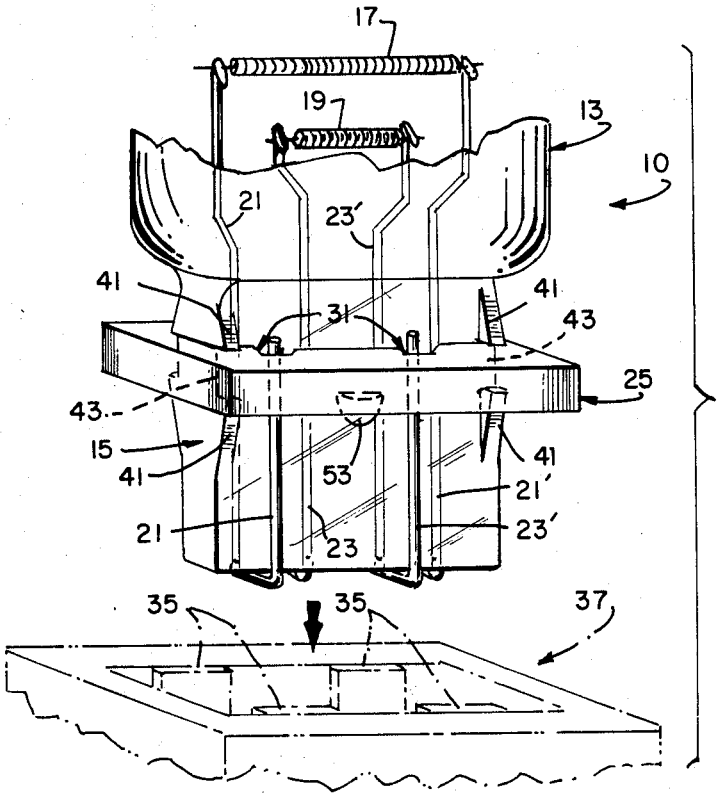
FIG. 2 is a perspective view of the invention, depicting teh base member thereof positioned on the press sealed end portion of the lamp's envelope.

With particular attention to the drawings, there is illustrated an electric incandescent lamp 10 in accordance with the teachings of the invention. Lamp 10, as stated above, is particularly adapted for use as part of a tail light assembly in an automobile but it will also be understood from the teachings herein that the invention has many further uses (e.g., automobile and aircraft instrument lighting, telephone switchboard lighting, etc.) and these teachings are thus not limited to this particular environment. Lamp 10 includes a light-transmitting envelope in the form of a glass (e.g., lime glass) bulb 13, said bulb containing therein a rare gas such as argon established at approximately atmospheric pressure. Bulb 13 is press (pinch) sealed at one end thereof using a pressing operation known in the incandescent lamp industry. Accordingly, further description is not believed necessary. As a result of this pressing operation, a flattened, sealed end portion 15 is formed as part of bult 13 adjacent the bulbuous part of the envelope. End portion 15 is of substantially rectangular configuration when viewed in cross section therethrough, in comparison to the bulbous shape of bulb 13, which may be either substantially cylindrical (tubular) or spherical (round) in shape. Although only part of bulb 13 is depicted in FIGS. 1 and 2, it is understood that the non-illustrated portion thereof forms a closure (e.g., is "tipped" or similarly sealed) in much the same manner as the bulbs depicted in the aforementioned two patents. These patents are thus incorporated herein by reference. As will be explained in greater detail below, forming end portion 15 in the manner and shape defined constitutes an important aspect of the invention. More specifically, end portion 15 as formed by such a pressing technique possesses greater strength (resistance to breakage) over ends sealed using a tipping operation or the like, or sealed in the manner defined in the aforementioned U.S. Pat. Nos. 3,979,627 and 4,028,577. In addition, the substantially rectangular (in cross section) shape resulting from this technique is particularly suited for placement thereon of an insulative base possessing the unique features also taught hereinbelow.

Located within bulb 13 is a pair of filaments 17 and 19 (FIG. 2), each of which is electrically connected to (and secured by) a corresponding pair of lead-in conductors which are hermetically sealed within end portion 15 of bulb 13 and project externally thereof. The opposing ends of each pair extend within the interior of bulb 13 and may be bent as indicated to assure the desired positioning for both filaments. With particular attention to the drawings, filament 17 is connected (and energized) by lead-in conductors 21 and 21', while filament 19 is connected by conductors 23 and 23'. A total of four conductors thus project exteriorly from sealed end portion 15.

In accordance with one embodiment of the invention, filaments 17 and 19 were each of coiled configuration and comprised of tungsten. By the term coiled configuration is meant that each filament may constitute a singular coil or, alternatively, may be a coiled-coil member. Retention of each filament by the associated pair of lead-in conductors is attained by crimping the interior ends thereof over the opposed ends of the linear filament, said procedure known in the art of incandescent lamp making. Each lead-in conductor may be comprised of a metallic alloy material (e.g., dumet) or similar conductive material known in the art. In one embodiment, each conductor possessed an external diameter (O D.)of about 0.02 inch and a total length of about 1.75 inch, of which about 0.60 inch projects externally from end portion 15.

In accordance with the teachings of the invention, lamp 10 further includes an electrically insulating base member 25 designed for being securedly positioned on the press sealed end portion 15 of bulb 13 adjacent the bulbous portion thereof and thus providing a cover for this first part of the press sealed end portion. As illustrated, base member 25 is of substantially rectangular configuration and defines therein an elongated opening 26 designed for having the corresponding, substantially rectangular shaped press sealed end portion 15 inserted therein.

Base member 25 is of substantially narrow thickness and, being plastic, is therefore above to expand in the region of elongated opening 26 during said positioning to thus substantially prevent damage to the glass press sealed end portion 15 as might be caused by excessive compression thereof.

Base member 25 includes therein means 31 for maintaining the exteriorly projecting portions of lead-in conductors 21, 21', 23 and 23' in precise alignment against the illustrated external surfaces of the press sealed end portion 15 to thus assure positive connection thereto by the corresponding contacts (i.e., 35, shown in phantom in FIG. 2) as might be located within a socket 37 (also shown in phantom in FIG. 2) in which lamp 10 may be inserted. As understood herein, lamp 10 is particularly adapted for being so positioned within a socket such as illustrated in FIG. 2 and is able to do so without the full coverage of the protruding second part of the press sealed portion as is often provided in lamps of the prior art.

Means 31 includes a plurality of slots, each designed for accommodating a respective one of the lead-in conductors. As illustrated in FIG. 1, these slots are arranged in pairs, each pair being located within an internal wall of base member 25 adjacent rectangular opening 26. As such, a total of four slots are provided when four lead-in conductors are utilized. It is understood, of course, that the teachings of the instant invention also apply to singular filament lamps wherein only two lead-in conductors are employed. As shown in FIG. 2, the uppermost end portions of these conductors are securedly positioned within a respective slot when base member 25 is fully positioned on end portion 15. Alignment is thus assured in order that the aforementioned electrical connection can be readily accomplished.

To facilitate positioning of base member 25 on press sealed end 15, the press sealed end portion includes thereon a plurality of upstanding segments 41 which, as illustrated, are arranged in pairs to define therebetween a receiving channel 43. Accordingly, the relatively thin base member 25 is designed for being positioned within each channel 43 in the manner illustrated. Uniquely, the base member 25 has been able to expand in the manner defined above in order to attain this final resting position. Such expansion is understandably necessary in order for the base member 25 to pass over the upwardly projecting segments 41 during positioning. The uppermost segments 41 thus serve to prevent further upward movement by the base 25 and therefore define the uppermost position therefor. Each channel 43 (a total of four are preferably utilized) is of a width only slightly greater than the overall, narrow width for base member 25 to therefore assure that the base member will be snugly positioned therein and thus prevented from ready removal from press sealed end portion 15. With particular attention to the drawings, two pairs of upstanding segments are spacedly positioned on a respective one of the larger external surfaces of the press sealed end portion 15 in the manner depicted. This spaced apart arrangement is preferred to assure the aforementioned snug positioning of base member 25 relative to the lowermost end wall (51) of end portion 15. This aligned positioning is further assured by provision of a pair of upstanding elements 53 (only one is shown in the drawings), each of which is located on one of the respective larger surfaces of the press sealed end portion and is designed for engaging a bottom surface of the base member when said member is firmly positioned within the aforementioned channels 43. Each of these upstanding elements thus serve to assist in retaining the base member within said channels.

There has thus been shown and described an electric incandescent lamp wherein the externally projecting portions of the lamp's lead-in conductors are maintained in precise alignment in a relatively simple and inexpensive manner during insertion of the lamp within a corresponding socket member. The unique arrangement as defined herein, utilizing a press sealed end portion for the lamp's envelope, enables the lowermost portion of this end portion to be directly inserted within the socket and thereby enable positive electrical contact to relatively large portions of the exteriorly projecting conductors, thereby assuring sound connection thereto. As understood herein, the relatively simple design of the base member of the invention assures low cost production thereof, in addition to eliminating the aforementioned soldering and cementing requirements typically necessary in many lamps of the prior art.

While there have been shown and described what are at present considered the preferred embodiments of the invention, it will be obvious to those skilled in the art that various changes and modifications may be made therein without departing from the scope of the invention as defined by the appended claims.

What is claimed is:

1. An electric lamp comprising:

a sealed, light-tranmitting envelope having a bulbous portion and a press sealed end portion, said sealed end portion substantially rectangular in cross section and including a first part and a second part adjacent thereto;

at least one filament located within the interior of said bulbous portion of said envelope;

a pair of lead-in conductors each connected at one end thereof to said filament, each of said conductors sealed within said press sealed end portion of said envelope and projecting exteriorly thereof; and an electrically insulating base member including an elongated opening and secured to said first part of said press sealed end portion of said envelope adjacent said bulbous portion and providing a cover for only said first part such that said first part is located within said opening, said base member including therein means for maintaining the exteriorly projecting portions of said lead-in conductors in predetermined alignment against a respective external surface of said press sealed end portion, said alignment maintaining means comprising a pair of slots, each of said slots being located within a respective internal wall of said base member and having a respective one of said lead-in conductors located therein, said second part of said sealed end portion not covered by said base member and adapted for being positioned within a socket member or the like for providing electrical contact to said lead-in conductors in the region of said press sealed end portion adjacent said second part, said conductors projecting exteriorly of said press sealed end portion at said second part, said base member being of unitary construction and expandable in the region of said elongated opening to facilitate positioning of said base member on said press sealed end portion.

2. The electric lamp according to claim 1 wherein said first part of said press sealed end portion of said envelope includes at least two upstanding segments thereon defining a receiving channel therebetween, said base member being snugly located within said receiving channel when positioned on said press sealed end portion.

3. The electric lamp according to claim 2 wherein the member of said pairs of upstanding segments defining a receiving channel therebetween is two, both of said pairs being spacedly positioned on said external surface of said press sealed end portion, said base member being positioned within both of the receiving channels defined by said pairs.

4. The electric lamp according to claim 3 further including an upstanding element located on said external surface of said press sealed end portion substantially between said spacedly positioned pairs of said upstanding segments for engaging a surface of said base member when said base member is located within said receiving channels to thereby assist in retaining said base member therein.

5. The electric lamp according to claim 1 wherein said envelope is glass and said base member is plastic.

* * * * *